US011097811B2

(12) United States Patent
Biousse

(10) Patent No.: US 11,097,811 B2
(45) Date of Patent: Aug. 24, 2021

(54) SYSTEM FOR SECURING A SUBMERGED BUOY

(71) Applicant: SCATRI SA, Nyon (CH)

(72) Inventor: Patrice Biousse, La Roche de Glun (FR)

(73) Assignee: SCATRI SA, Nyon (CH)

( * ) Notice: Subject to any disclaimer, the term of this patent is extended or adjusted under 35 U.S.C. 154(b) by 0 days.

(21) Appl. No.: 16/482,820

(22) PCT Filed: Jan. 31, 2018

(86) PCT No.: PCT/FR2018/050231
§ 371 (c)(1),
(2) Date: Aug. 1, 2019

(87) PCT Pub. No.: WO2018/142073
PCT Pub. Date: Aug. 9, 2018

(65) Prior Publication Data

US 2019/0351978 A1 Nov. 21, 2019

(30) Foreign Application Priority Data

Feb. 1, 2017 (FR) ..... 17 50845

(51) Int. Cl.
*B63B 22/14* (2006.01)
*B63C 7/26* (2006.01)
(Continued)

(52) U.S. Cl.
CPC ..... *B63B 22/14* (2013.01); *B63B 45/00* (2013.01); *B63C 7/26* (2013.01); *B63B 35/14* (2013.01)

(58) Field of Classification Search
CPC ..... B63B 22/14; B63B 45/00; B63B 35/14; B63B 22/08; B63B 22/24; B63B 22/28; B63C 7/26
See application file for complete search history.

(56) References Cited

U.S. PATENT DOCUMENTS 3,310,820 A * 3/1967 Elo ..... B63B 22/06 441/8
3,749,933 A * 7/1973 Davidson ..... B63B 21/60 307/116

(Continued)

FOREIGN PATENT DOCUMENTS

FR 3033156 A1 9/2016
WO 92/21557 A1 12/1992

OTHER PUBLICATIONS

International Search Report and Written Opinion dated Mar. 16, 2018 in corresponding International Application No. PCT/FR2018/050231; 14 pages.

*Primary Examiner* — Anthony D Wiest
(74) *Attorney, Agent, or Firm* — Maier & Maier, PLLC

(57) ABSTRACT

A system for securing a submerged buoy including a signalling element floating on the surface and connected to the buoy by a link, said securing system being wherein it includes a reversible coupling device comprising an attachment member secured to the end of the link opposite the signalling element, a complementary attachment member rigidly connected to the buoy and capable of engaging with said attachment member in order to allow the link to be secured to or released from the buoy, a pressure sensor, a control unit associated with a timemeasurement unit, said control unit ordering said complementary attachment member to separate from said attachment member when a pressure variation, measured by associating said pressure sensor and said time-measurement unit, is higher than a set value.

14 Claims, 2 Drawing Sheets

(51) Int. Cl.
*B63B 45/00* (2006.01)
*B63B 35/14* (2006.01)

(56) References Cited

U.S. PATENT DOCUMENTS

| | | | | |
|---|---|---|---|---|
| 4,118,060 | A | 10/1978 | Brown | |
| 4,189,786 | A * | 2/1980 | Adler | B63B 22/14 367/133 |
| 5,100,353 | A * | 3/1992 | Domborwski | B63B 22/06 441/2 |
| 7,534,152 | B1 * | 5/2009 | Lloyd | B63B 22/06 441/2 |
| 8,353,735 | B2 * | 1/2013 | Biousse | B63B 22/06 441/2 |
| 9,102,390 | B2 * | 8/2015 | Kawahara | B66D 1/60 |

* cited by examiner

SYSTEM FOR SECURING A SUBMERGED BUOY

TECHNICAL FIELD

The present invention relates to a system for securing a submerged buoy from theft and external attack, such a buoy being equipped with means for ensuring the rise thereof to the surface on command in accordance with the standards and directives in force.

BACKGROUND

In the field of underwater buoys, a submerged buoy is already known for locating fishing gear and consisting of a casing enclosing a radio-acoustic signal receiver, a mooring rope attached at one of the ends thereof to a mooring point, a mechanism for releasing the buoy enabling it to rise to the surface, and a flotation reserve; said electromechanical release mechanism is enclosed in a hermetically-sealed tank thus constituting the flotation reserve, and controls a catch that either prevents or allows the free rotation of a winding drum around which the mooring rope is coiled. This type of buoy is very simple in design and the operation thereof is entirely reversible. However, this type of buoy does not offer any guarantee in terms of protection from external attacks such as, for example, theft or even strong sea currents resulting in the impossibility of locating the buoy or the loss thereof and thus the loss of the object associated therewith. Moreover, this drawback is contrary to the recent calls by the FAO (Food and Agriculture Organization of the United Nations), which is an intergovernmental organisation in particular working towards harmonising standards in the fields of fishing. More specifically, in its 2010 report, the FAO calls for the fishing sector to make every effort to recover fishing gear lost at sea in order to prevent "ghost fishing", which causes very extensive and unnecessary deterioration of the halieutic resource, and which thus has a very high ecological impact. Moreover, this type of buoy is also not compliant with international legislation which aims to prohibit the concealment of any gear whatsoever underwater in order to prevent collision risks with boats.

These various drawbacks are partially overcome thanks to a submerged buoy similar to that described hereinabove, and provided with a securing mechanism such as, for example, that described in the patent application FR 3 033 156 filed by the Applicant. Said securing system includes a signalling element capable of floating on the surface and connected to the submerged buoy by a link including a weakening means capable of rupturing when a force greater than a predetermined value is exerted at the end thereof located on the same side as the signalling element, and a ballasted keel extending beneath the buoy and being disposed in the longitudinal plane of vertical symmetry of the buoy with the point of pivoting of the submerged buoy and the fastening point of said link and therebetween.

However, this assembly has a certain number of drawbacks. Thus, the "breakable" link capable of rupturing has a weakness during use, since if the user does not correctly dimension the predetermined value for the rupture of the breakable link, the rupture can occur prematurely, or conversely may not occur at all. The determination of said predetermined value is particularly difficult, since in particular the force resulting from the winds and currents that will likely be applied to the signalling element at the surface and on the breakable link must be taken into consideration. The determination of said value is especially delicate since the signalling element at the surface is very often handcrafted and thus differs from one buoy to another on the same boat.

Finally, said securing system does not easily allow for the differentiation between the different types of movements of the submerged buoy: descending or ascending, slow or fast, normal, resulting for example from the tide, or abnormal.

DESCRIPTION OF THE INVENTION

The present invention thus aims to propose a system for securing a submerged buoy equipped with means for ensuring the rise thereof to the surface on command, compliant with the expectations and legislations in force regarding ghost fishing and submerged objects, said system allowing the submerged buoy to be secured, in a reliable and durable manner, from theft and deterioration caused by the use thereof and/or by the marine environment.

In this respect, the present invention relates to a system for securing a submerged buoy equipped with means for ensuring the rise thereof to the surface on command and comprising at least one casing enclosing a radio-acoustic signal receiver, a mooring rope attached at one of the ends thereof to an anchored mooring point, a release mechanism allowing said buoy to rise to the surface, and a battery; the securing system including a signalling element capable of floating on the surface and connected to the buoy by a link, said securing system being noteworthy in that it includes a reversible coupling device comprising an attachment member secured to the end of the link opposite the signalling element, a complementary attachment member rigidly connected to the buoy and capable of engaging with said attachment member in order to allow the link to be rigidly connected to or separated from the buoy, a pressure sensor, and a control unit associated with a time-measurement unit, said control unit instructing said complementary attachment member to separate from said attachment member when a pressure variation, measured by associating said pressure sensor and said time-measurement unit, is higher than a setpoint value.

The setpoint value preferably corresponds to the pressure variation in time as a result of the world's greatest recorded tidal range.

According to an alternative embodiment, the coupling device includes a "breakable" fastener fastened on one side to the buoy and on the other side to the attachment member of the link, and dimensioned so as to rupture when said tensile force exceeds a predetermined value.

According to another alternative embodiment, the coupling device includes a "breakable" fastener fastened on one side to the attachment member of the link and on the other side to the buoy via a release clip capable of separating from the buoy when said tensile force exceeds a predetermined value.

Advantageously, the securing system includes a ballasted keel extending beneath the buoy and disposed between the point of pivoting of the buoy and the attachment member of the link, said keel, the point of pivoting of the buoy and the attachment member of the link being disposed in the longitudinal plane of vertical symmetry of the buoy.

The securing system preferably includes a pressure sensor rigidly connected to the buoy, capable of recording a sudden pressure rise beyond a setpoint depth and of sending, where appropriate, the information to the release mechanism in order to raise said buoy to said setpoint depth.

Advantageously, the securing system comprises a humidity sensor located inside the casing in the area receiving the electrical and/or electronic components, and is capable, where appropriate, of triggering the release mechanism and of raising the buoy to the surface.

The securing system preferably includes a member for permanently monitoring the battery of the buoy capable of triggering the release mechanism and of raising the buoy to the surface as soon as the level of the battery reaches a minimum threshold.

The humidity sensor and the battery monitoring member are advantageously associated with indicator lights visible from the outside of the casing of the buoy.

Advantageously, the securing system comprises a flash lamp equipping the casing of the buoy and including at least one bulb disposed beneath a transparent protective enclosure secured to the top of a body containing a control unit associated with a twilight sensor and a pressure sensor, such that the lamp only flashes when it is dark and if the lamp is out of the water.

The lamp preferably includes a communication antenna compatible with AIS network signals and associated with a position determination device for alerting the buoy owner if said buoy rises to the surface.

Advantageously, the securing system includes a probe arranged such that it is rigidly connected to the hull of a boat and comprising a ceramic transducer having an overall hemispherical shape.

According to one advantageous embodiment, the securing system includes a remote probe similar to said probe.

Finally, the system for securing the submerged buoy that includes a specific and unique code for the actuation of the buoy on the surface by the owner thereof is advantageously equipped with a complementary coding device for simultaneously actuating the release mechanism of a series of submerged buoys thanks to a single code, referred to as a "Passcode".

BRIEF DESCRIPTION OF THE FIGURES

Other advantages and features will be better understood upon reading the following description of one alternative embodiment of a securing system according to the invention for securing a submerged buoy, given with reference to the accompanying drawings, in which.

BEST WAY OF CARRYING OUT THE TECHNICAL INVENTION

Figure 1:
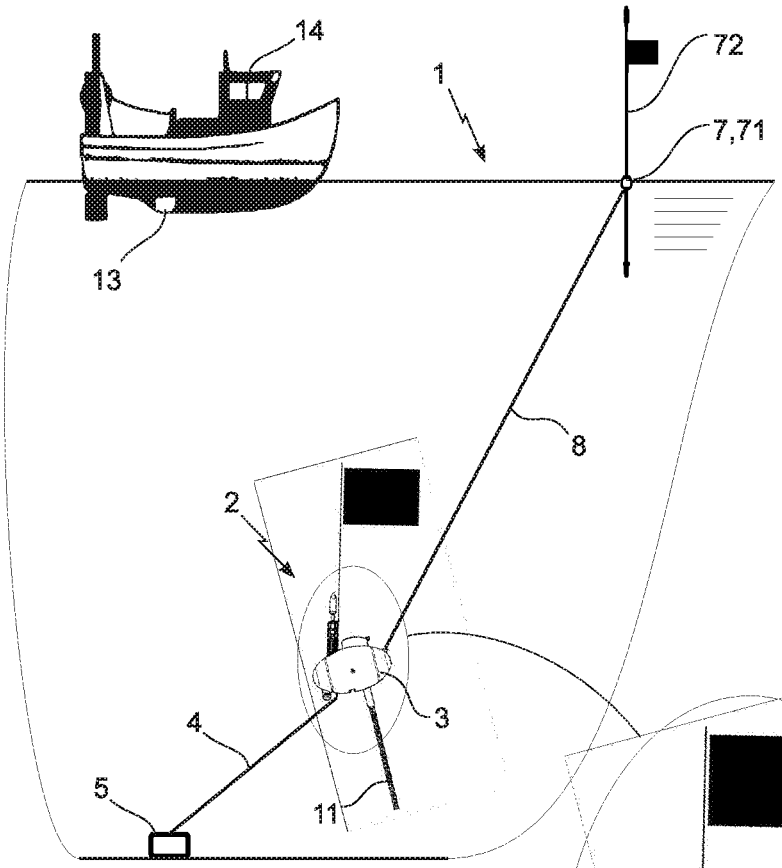
FIG. 1 is a diagrammatic general view of a submerged buoy provided with the securing system according to the invention.
Figure 2:
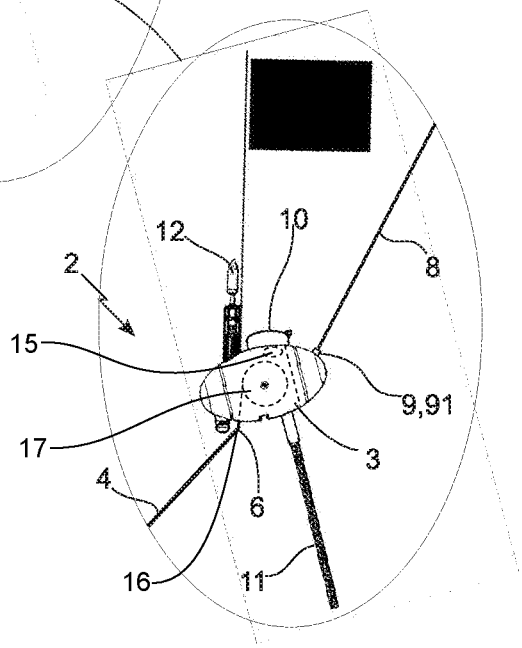
FIG. 2 is an enlarged detailed view of the securing system in FIG. 1.

FIGS. 1 to 2 show the securing system 1 according to the invention for securing a submerged buoy 2 equipped with means for ensuring the rise thereof to the surface on command. According to one partially-illustrated embodiment, said buoy 2 advantageously includes:

- a casing 3 enclosing a radio-acoustic signal receiver 15 and formed by two shell halves assembled together by screwing or by any other suitable means, said casing 3 preferably having an outer shape that has a hydrodynamic profile, advantageously having an overall axisymmetric ellipsoidal shape, providing it with low sensitivity to sea currents,
- a mooring rope 4 connected at one of the ends thereof to a mooring point 5 anchored in a conventional manner in the seabed,
- a release mechanism 17, allowing said buoy 2 to rise to the surface, said release mechanism 17 advantageously being of the electromechanical type and enclosed in a hermetically-sealed vessel forming a flotation reserve, said release mechanism 17 controlling a catch preventing or allowing the free rotation of a winding drum around which the mooring rope 4 is coiled, the mooring rope 4 passing through an output point 6 made on the casing 3 of the buoy 2 so as to be connected to said anchor point 5, said output point 6 corresponding to the point of pivoting 16 of the buoy 2 and
- at least one battery 98 supplying electrical energy, in particular to said release mechanism 17.

The buoy 2, which under normal conditions of use is submerged at a depth of about 40 metres, and in particular the casing 3 thereof, is clearly designed to withstand submersion at a depth of up to 80 metres in order to overcome handling errors and the action of sea currents of up to 5 knots.

In order to comply with international regulations aiming to prohibit the concealment of an object underwater, the securing system 1 includes a signalling element 7 that floats on the surface and is connected to the buoy 2 by a link 8, said signalling element 7 advantageously comprising a float 71 provided with a flag 72.

The link 8 is connected to the buoy 2 by a coupling device 9 capable of separating said link 8 from the buoy 2 under certain conditions.

Figure 3:
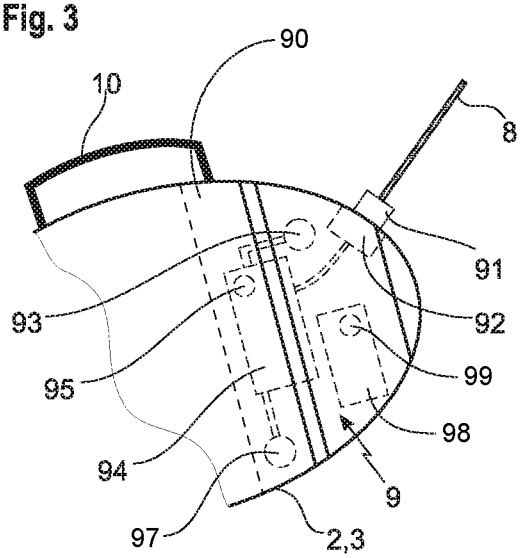
FIG. 3 is a diagrammatic detailed view of the coupling device of the securing system in FIG. 1.

With reference to FIG. 3, the reversible coupling device 9 includes an attachment member 91 secured to the end of the link 8 opposite the signalling element 7, a complementary attachment member 92 rigidly connected to the casing 3 of the buoy 2 and capable of engaging with said attachment member 91 in order to allow the link 8 to be rigidly connected to or separated from the casing 3 of the buoy 2, a pressure sensor 93, and a control unit 94 associated with a time-measurement unit 95.

The attachment member 91 is advantageously selected from the group consisting of a metal part, a ring, a shackle, a thimble or a cringle. The complementary attachment member 92 is thus advantageously selected from the group consisting of an electromagnet, a clip, a hook or a lever. Said complementary attachment member 92 is capable of retaining the link 8 rigidly connected to the buoy 2 despite the forces caused by the winds, waves and sea currents exerted on the signalling element 7.

However, it is understood that the attachment member 91 and complementary attachment member 92 could be replaced by any member procuring the same effects while still remaining within the scope of the present invention.

The control unit 94 is a printed circuit board powered by the battery 98 associated with the release mechanism 17 or by a specific battery, not shown. Said control unit 94 is capable of instructing the complementary attachment member 92 to allow the attachment member 91 to be rigidly connected to or separated from the casing 3 of the buoy 2, and thus the link 8 to be rigidly connected thereto or separated therefrom, as a function of the data from the pressure sensor 93 coupled with those from the time-measurement unit 95.

Thus, in the absence of any normal triggering of the release mechanism 17 which results in quickly raising the buoy 2, when a significant and fast pressure variation, which is measured by associating the pressure sensor 93 with the time-measurement unit 95, is detected by the control unit 94, said unit instructs the complementary attachment member 92 to allow the attachment member 91 to be separated from the buoy 2, and thus the signalling element 7 to be separated therefrom.

In order to be certain that this significant (with regard to quantity) and fast (with regard to time) variation is only the result of an accidental rise of the buoy 2 (link 8 caught in the propeller or net of a boat for example) or intentional rise thereof (attempt to steal the buoy 2), the control unit 94 is calibrated relative to a setpoint value advantageously corresponding to the pressure variation in time, i.e. per unit of time such as in minutes, for example, (which is significant and fast) generated by the greatest tidal range, i.e. the greatest difference in water level between a successive high tide and low tide, recorded in the world, i.e. this is currently the tidal range recorded in the Bay of Fundy, Canada, which is equal to 3.4 metres per hour. For this purpose, when a pressure variation per unit of time, measured by associating the pressure sensor 93 and the time-measurement unit 95, is greater than said setpoint value, the control unit 94 thus instructs the complementary attachment member 92 to separate from the attachment member 91; conversely separation does not take place.

Thus, it is understood that if the pressure sensor 93 and the time-measurement unit 95 measure a significant pressure variation in a short lapse of time, of about several seconds or one minute, the control unit 94 will instruct the complementary attachment member 92 to separate from the attachment member 91, since this will probably concern an unauthorised rise of the buoy 2.

Moreover, in order to ensure that the buoy 2 is submerged at the desired depth, the pressure sensor 93 of the securing system 1 will be able to be used to record a sudden pressure rise beyond a setpoint depth, i.e. a depth of 40 metres. In the case where such a sudden pressure rise is recorded, said pressure sensor 93 sends the information to the release mechanism 17 in order to raise said buoy 2 to said setpoint depth. In general, the pressure sensor readjusts the position of the buoy as soon as the pressure measured rises by 0.5 bar.

However, in the case where the descent of the buoy 2 beyond metres is specifically the result of sea currents, the pressure increases gradually and the pressure sensor 93 does not send any message to the release mechanism 17.

This pressure sensor 93 further allows liabilities to be determined in the event of damage caused by leaks in the buoy 2 by acting as an informant providing the maximum depth to which the buoy 2 was submerged.

However, for the latter two uses, the securing system 1 can include another pressure sensor different from the pressure sensor 93 associated with the coupling device 9, while still remaining within the scope of the present invention.

Figure 4:
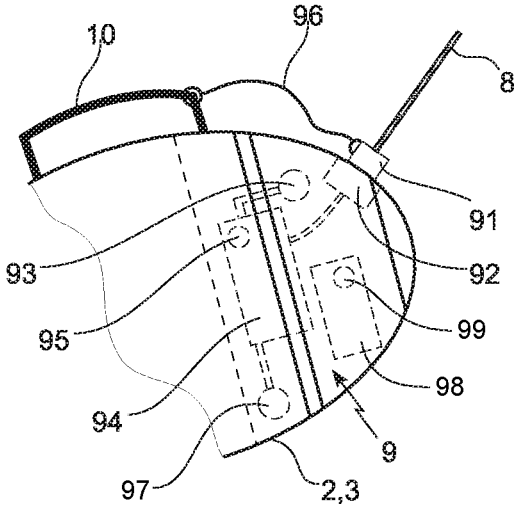
FIG. 4 is a diagrammatic detailed view of an alternative embodiment of the coupling device of the securing system in FIG. 1.

According to an alternative embodiment shown in FIG. 4, the coupling device 9 of the securing system 1 includes a "breakable" fastener 96 fastened on one side to the casing 3 of the buoy 2, for example by being tied to the carrying handle 10 of the buoy 2 and on the other side to the attachment member 91 of the link 8. This "breakable" fastener 96 is either dimensioned such that it ruptures when the force exceeds the determined value, or secured to the buoy 2 via a release clip, not shown, capable of being separated from the buoy 2 when the force exceeds said predetermined value. A person skilled in the art will not find it difficult to calculate this predetermined value as a function of the dimensions of the buoy 2, the mooring rope 4 thereof and the value of the sea current applied to the float 71 of the signalling element 7.

This alternative embodiment prevents the loss of the signalling element 7 when raising a buoy 2. More specifically, when raising fishing gear, the fisherman will normally trigger the release mechanism 17 of a buoy 2, which results in the fast rise thereof. However, fishing gear is generally equipped with at least two buoys 2. Thus, when raising fishing gear, the second buoy 2, the release mechanism 17 whereof has not been triggered, will quickly rise and the coupling device 9 thereof will thus be triggered and instruct the separation of the signalling element 7 from the buoy 2, however the link 8 will be retained by the "breakable" fastener 96 in order to prevent, in this precise case, the loss of said signalling element 7. However, the "breakable" fastener 96 is intended to break if the buoy 2 is accidentally raised (link 8 caught in the propeller or net of a boat for example) or intentionally raised (attempt to steal the buoy 2).

Moreover, even though the buoy 2 is designed to withstand submersion at a depth of up to 80 metres, it can have a manufacturing defect that could result in a small leak. In order to overcome this drawback, the securing system 1 comprises a humidity sensor 97, which is located inside the casing 3 in the area receiving the electrical and/or electronic components 90. Thus, if a small quantity of humidity is detected, the release mechanism 17 is automatically triggered and the buoy 2 rises quickly, in under 8 seconds, to the surface. The casing 3 is thus no longer subjected to any pressure and the damage to said components is minimised.

The securing system 1 according to the invention further includes a member for permanently monitoring the battery 98 of the buoy 2. Thus, as soon as the battery level reaches a minimum threshold, said monitoring member 99 sends information in order to trigger the release mechanism 17 and raise the buoy 2 to the surface, so as to allow recovery of said buoy 2 by the owner thereof.

According to one preferred embodiment, the humidity sensor 97 and the battery monitoring member 99 are associated with indicator lights visible from the outside of the casing 3 of the buoy 2 and indicating the type of defect to the user. Thus, said user is immediately aware of whether this involves water intake or a poorly charged battery.

With this configuration, the assembly comprising the buoy 2, the mooring rope 4 thereof, the signalling element 7, the link 8 and the coupling device 9 does not have satisfactory stability, in particular when the sea currents exceed 5 knots. However, it is of vital importance that the stability of the buoy 2 is guaranteed, i.e. that the buoy 2 is always disposed such that the angle between an axis perpendicular to the flotation plane thereof and the vertical lies in the range −10 to +10 degrees so that the radio-acoustic signal receiver 15 of the casing 3 of the buoy 2 is always capable of receiving a signal emitted by a probe rigidly connected, for example, to a boat. More specifically, if the buoy 2 is incorrectly positioned, the receiver will no longer be able to receive a signal, and the owner of the buoy 2 will no longer be able to recover it nor the fishing gear associated therewith, which is contrary to the expectations of the FAO in the fight against ghost fishing. In order to overcome this problem, it is understood that numerous factors must be taken into consideration such as, for example, the position of the point of pivoting 16 of the buoy 2 corresponding to the output 6 of the mooring rope 4, the position of the attachment member 91 of the link 8, the drag force exerted by the sea current on the buoy 2, the signalling element 7 and the link 8, or the drag force exerted by the sea current on the mooring rope 4.

However, in order to overcome this problem in a simpler manner, the securing system includes a ballasted keel 11 extending beneath the buoy 2, the dimensions and the position whereof relative to the positions of the point of pivoting 16 of the buoy 2 and the fastening point of the link 8 allow the stability of the buoy 2 to be guaranteed for sea currents of up to 7 knots, the keel 11 and the point of pivoting 16 of the buoy 2 and the attachment member 91 of the link 8 being disposed in the longitudinal plane of vertical symmetry of the casing 3 of the buoy 2, the keel 11 being disposed between said point of pivoting 16 of the buoy 2 and the attachment member 91 of the link 8.

Figure 5:
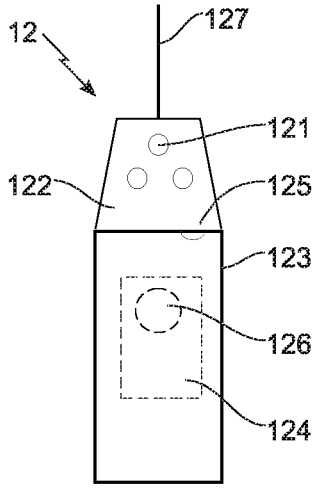
FIG. 5 is a diagrammatic detailed view of the flash lamp of the securing system in FIG. 1.

Moreover, with reference to FIGS. 2 and 5, in order to comply with regulations aiming to improve night-time signalling of a floating object in order to limit collision risks, the securing system 1 comprises a flash lamp 12 equipping the casing 3 of the buoy 2.

Said lamp 12 advantageously includes at least one bulb 121 disposed beneath a transparent protective enclosure 122 secured to the top of a body 123 containing a control unit 124 associated with a twilight sensor 125 and a pressure sensor 126, similar to the pressure sensor 93 of the aforementioned coupling device.

Thus, in the dark, the lamp 12 will only flash if the buoy 2 is on the surface, i.e. if the lamp 12 is out of the water.

The lamp 12 can be powered by its own battery, however is preferably powered by the battery 98 associated with the release mechanism 17.

Moreover, the lamp 12 can include a communication antenna 127 compatible with AIS network signals, AIS (Automatic Identification System) being a system for automatically identifying vessels initially developed as an anti-collision tool for commercial vessels, allowing each vessel to "see" the other vessels present in the vicinity thereof. The communication antenna 127 is associated with a position determination device, not shown, of the GPS (Global Positioning System) type, contained in the casing 3 of the buoy 2 and using the AIS network.

Thus, with the position determination device, if the buoy 2 rises to the surface, the owner of the buoy 2 is alerted and receives the position of said buoy 2 in order to go to the site and recover it. Then, if the position of the buoy 2 varies, indicating an entanglement or transfer to a vessel, the owner can also track said buoy to recover it or ensure the recovery thereof by the competent authorities.

Moreover, the on-board AIS allows all boats equipped therewith to locate, even in poor visibility conditions, an obstacle that the buoy 2 on the surface can represent and thus avoid it.

Moreover, similarly to boat radio stations, the buoy 2 is equipped, in accordance with regulations, with a MMSI (Maritime Mobile Service Identity) code, coding all digital selective calling systems and issued by the national frequencies agencies. Thus, if the buoy 2 is brought on board a third party boat, the two MMSI codes, that of the third party boat and that of the buoy 2 will be superimposed on the control screen of the owner of the buoy 2, who will thus immediately obtain the identification of the third party boat and, where appropriate, call the police authorities to resolve any litigation.

Moreover, with reference to FIG. 1, in order to heighten security for when a signal is received by the radio-acoustic signal receiver 15 of the casing 3 of the buoy 2, the securing system 1 includes a probe 13 arranged such that it is rigidly connected, for example, to the hull of a boat 14 comprising a ceramic transducer having an overall hemispherical shape allowing streams of codes to be propagated in a hemispherical manner and at high rates of about one stream every 200 milliseconds. Said probe 13 thus allows the release mechanism 17 to be triggered and the buoy 2 to be raised to the surface, regardless of the position thereof, and regardless of the trim and the list of the boat, even in the case of rough seas. Moreover, this probe 13 allows the range of the signals emitted to be increased and significantly reduces the cavitation phenomena which appear when the boat is travelling at a speed exceeding 10 knots and which would distort the signal emitted.

Moreover, the power to be supplied in order to operate the probe 13 is such that, when said probe 13 is too close to the buoy, the signal emitted becomes inaudible, a little like the Larsen phenomenon. This quite surprising phenomenon prevents the risk of a buoy rising beneath the boat carrying the probe 13 and becoming damaged.

The securing system 1 can include a remote probe, not shown, which is of similar design to the aforementioned probe 13 and which has two main functions. The first function allows the user to raise the buoys 2 thereof in the event of damage to the probe 13 positioned under the boat. The second function concerns certain parts of the world. More specifically, in some cases, strong thermoclines can be found at sea, which can significantly deteriorate the range of the signal emitted, to the extent that in some rare cases, the signal is no longer conveyed. In such a case, although exceptional, the user connects the remote probe and lowers it to a few metres above the buoy 2 to be raised in order to guarantee receipt of the signal by the receiver of said buoy 2.

Finally, the system 1 for securing the submerged buoy 2 that includes a specific and unique code for the actuation of the buoy 2 on the surface by the owner thereof is advantageously equipped with a complementary coding device for simultaneously actuating the release mechanism 17 of a series of submerged buoys 2 thanks to a single code, referred to as a "Passcode". This allows the owner of a series of buoys 2 or the user authorised thereby to avoid successively transmitting the specific code for each buoy 2 in the series for the actuation thereof, by raising all buoys 2 to the surface at the same time.

Secondarily, in addition to saving a lot of time, an owner that has omitted to record a specific code when submerging the buoys 2 is guaranteed to recover all buoys using the "Passcode".

POSSIBLE INDUSTRIAL APPLICATION

It is understood that the securing system 1 according to the invention is primarily used to secure the buoys 2 intended for submerged fishing gear. However, the invention can advantageously also be applied to secure buoys 2 intended to delimit a sensitive area, for example a wreck or sea mines.

Finally, it goes without saying that the examples of the securing system 1 according to the invention that have been described above are only specific illustrations and in no way limit the invention.

The invention claimed is:

1. A system for securing a submerged buoy, comprising: equipping the submerged buoy to ensure the rise thereof to a surface on command and comprising at least one casing enclosing a radio-acoustic signal receiver, a mooring rope attached at one of the ends thereof to an anchored mooring point, a release mechanism allowing said buoy to rise to the surface, and a battery; the securing system including a signalling element capable of floating on the surface and connected to the buoy by a link, said securing system wherein including a reversible coupling device comprising an attachment member secured to the end of the link opposite the signalling element, a complementary attachment member rigidly connected to the buoy and capable of engaging with said attachment member in order to allow the link to be rigidly connected to or separated from the buoy, a pressure sensor, and a control unit associated with a time-measurement unit, said control unit instructing said complementary attachment member to separate from said attachment member when a pressure variation, measured by associating said pressure sensor and said time-measurement unit, is higher than a setpoint value.

2. The securing system according to claim 1, wherein the setpoint value corresponds to the pressure variation in time as a result of the world's greatest recorded tidal range.

3. The securing system according to claim 1, wherein the coupling device includes a "breakable" fastener fastened on one side to the buoy and on the other side to the attachment member of the link, and dimensioned so as to rupture when spa tensile force exceeds a predetermined value.

4. The securing system according to claim 1, wherein the coupling device comprises a "breakable" fastener fastened on one side to the attachment member of the link and on the other side to the buoy via a release clip capable of separating from the buoy when a tensile force exceeds a predetermined value.

5. The securing system according to claim 1, further comprising a ballasted keel extending beneath the buoy and disposed between a point of pivoting of the buoy and the attachment member of the link, said keel, the point of pivoting of the buoy and the attachment member of the link being disposed in the longitudinal plane of vertical symmetry of the buoy.

6. The securing system according to claim 1, further comprising a pressure sensor rigidly connected to the buoy, capable of recording a sudden pressure rise beyond a setpoint depth and of sending, where appropriate, information to the release mechanism in order to raise said buoy to said setpoint depth.

7. The securing system according to claim 1, further comprising a humidity sensor located inside the casing in an area receiving electrical and/or electronic components, and capable, where appropriate, of triggering the release mechanism and of raising the buoy to the surface.

8. The securing system according to claim 1, further comprising a member for permanently monitoring the battery of the buoy capable of triggering the release mechanism and of raising the buoy to the surface as soon as a level of the battery reaches a minimum threshold.

9. The securing system according to claim 7, wherein the humidity sensor and a battery monitoring member are associated with indicator lights visible from the outside of the casing of the buoy.

10. The securing system according to claim 1, further comprising a flash lamp equipping the casing of the buoy and including at least one bulb disposed beneath a transparent protective enclosure secured to a top of a body containing a control unit associated with a twilight sensor and a pressure sensor, such that the lamp only flashes when it is dark and if the lamp is out of the water.

11. The securing system according to claim 10, wherein the lamp includes a communication antenna compatible with AIS network signals and associated with a position determination device for alerting an owner of the buoy if the latter rises to the surface.

12. The securing system according to claim 1, further comprising a probe arranged such that it is rigidly connected to a hull of a boat and comprising a ceramic transducer having an overall hemispherical shape.

13. The securing system according to claim 12, further comprising a remote probe similar to said probe.

14. The securing system according to claim 1, including a specific and unique code for actuating the release mechanism of the buoy, further comprising a complementary coding device enabling the simultaneous actuation of the release mechanism of a series of buoys thanks to a single "Passcode".

* * * * *